US008444298B2

(12) United States Patent
Lin et al.

(10) Patent No.: US 8,444,298 B2
(45) Date of Patent: May 21, 2013

(54) LED LIGHTING DEVICE

(75) Inventors: Rong Gui Lin, New Taipei (TW); Chih Hui Chiang, New Taipei (TW); Chin Li Wu, New Taipei (TW)

(73) Assignee: Rong Gui Lin, New Taipei (TW)

( * ) Notice: Subject to any disclaimer, the term of this patent is extended or adjusted under 35 U.S.C. 154(b) by 0 days.

(21) Appl. No.: 13/478,096

(22) Filed: May 22, 2012

(65) Prior Publication Data

US 2012/0307484 A1 Dec. 6, 2012

(30) Foreign Application Priority Data

Jun. 3, 2011 (TW) ..... 100210199 U

(51) Int. Cl.
*F21V 21/00* (2006.01)
*F21V 29/00* (2006.01)

(52) U.S. Cl.
USPC ..... 362/249.02; 362/373; 362/431

(58) Field of Classification Search
USPC ..... 362/294, 373, 249.02, 431, 414, 362/238
See application file for complete search history.

(56) References Cited

U.S. PATENT DOCUMENTS

| | | | | |
|---|---|---|---|---|
| 7,651,245 | B2 * | 1/2010 | Thomas et al. | 362/294 |
| 8,322,897 | B2 * | 12/2012 | Blincoe et al. | 362/373 |
| 2009/0086481 | A1 * | 4/2009 | Wegner | 362/235 |
| 2010/0014289 | A1 * | 1/2010 | Thomas et al. | 362/235 |

* cited by examiner

*Primary Examiner* — Thomas Sember

(57) ABSTRACT

A light emitting diode (LED) lighting device includes a light case, a plurality of heatsinks, a plurality of LED modules and a plurality of power supplies. Each of the heatsinks is connected with one of the LED modules and one of the power supplies correspondingly to form one LED light unit. The LED light units are assembled with the light case to form the LED lighting device.

4 Claims, 6 Drawing Sheets

LED LIGHTING DEVICE

BACKGROUND OF THE INVENTION

1. Field of the Invention

The present invention relates to a LED light for illumination and more particularly to a LED lighting device which can be assembled with more or less units based on the requirement of brightness of the illumination and part of the components can be replaced when the LED lighting device is out of order.

2. The Prior Arts

The light emitting diode (LED) is becoming more popular for applying in illuminating purpose because of its characteristics of smaller size, lower energy consumption and longer lifetime than conventional lighting devices, as well as the remarkable technique advance in the brightness of illumination. Because of the small size of LED, the lumen of a single LED is still lower than that of an incandescent bulb, a fluorescent lamp or conventional lamps. Therefore, the LED lighting device presently on the market is usually a LED module composed of a plurality of LEDs. The light is concentrated from the plurality of LEDs to provide sufficient brightness for illumination. For example, a plurality of LEDs are assembled on a circuit board having a specific area or assembled in a lamp case for concentrating the light of the LEDs to provide the same illumination as a conventional light bulb or better illumination than a conventional light bulb. Furthermore, only 15 to 20 percent of an input power of a high power LED is converted into light and the remained 80 to 85 percent of the input power is converted into heat. Therefore, the LED module has to be equipped with an efficient heat sink to dissipate the heat and prevent the interfaces of the LED from being overheated to affect the illumination efficiency of the LED and to reduce the lifetime of the LED.

A LED lighting device served as a regular street lamp or outdoor lighting device usually includes a heatsink, a power supply and a LED module. The LED module includes a plurality of LEDs disposed on a circuit board and the LEDs would radiate the light after the power is turned on and supplied to the circuit board. The heatsink comprises a base and a plurality of fins disposed on a side of the base. The LED module is disposed on another side of the base opposite to the side where the fins are disposed. Thereby, the heat generated by the illuminating LED module is transferred to the fins and the heat is carried away from the fins by air flow.

Depending on the required brightness of illumination of the conventional LED lighting device mentioned above, the area of the LED module and the quantity of the LED are determined. The heatsink having a specific area is determined corresponding to the LED module and the power supply having a specific power is determined corresponding to the LED module. After the LED module, the heatsink and the power supply are assembled, it is a finished product of the LED lighting device. When it needs to increase or reduce the brightness of the illumination, the LED module, the heatsink or the power supply can not be expanded or contracted alone to adjust the brightness of illumination required for the site. The LED module, the heatsink and the power supply have to be replaced all together and matched again correspondingly. Therefore, the conventional LED lighting device lacks the flexibility of assembling and is not economical.

Furthermore, when some of the LED chips or part of the other electronic components of the LED module is in failure and needs replacement, it can not replace the failure part only and has to replace the entire LED module. In other words, the other non-failure parts are also replaced as well as the failure parts at the same time, which is uneconomical.

SUMMARY OF THE INVENTION

A primary objective of the present invention is to provide a LED lighting device that overcomes the disadvantage of conventional LED lighting devices having a LED module, a heatsink and a power supply. Once the LED module, the heatsink and the power supply are assembled to form the conventional LED lighting device and provide the predetermined brightness of illumination, the quantity of the LED module, the heatsink or the power supply can not be expanded or contracted alone to increase or reduce the brightness of illumination. If it needs to increase or reduce the brightness of illumination, the LED module, the heatsink and the power supply have to be replaced all together, which results in poor flexibility and is not economical for assembling the conventional LED lighting device.

Another objective of the present invention is to provide a LED lighting device that overcomes another disadvantage of conventional LED lighting devices having a LED module, a heatsink and a power supply. When some of the LED chips or part of the other electronic components of the LED module are in failure and need replacement, the conventional LED lighting device can not replace the failure part only and has to replace the entire LED module, which is not economical.

The characteristic of the present invention is that the LED lighting device includes LED modules and a plurality of heatsinks having relatively smaller areas than conventional designs, and each of the heatsinks is connected with an independent power supply having a relatively smaller power corresponding to the smaller LED module. The total areas of the LED modules and heatsinks can be expanded or contracted depending on the requirement of brightness of illumination, and the LED modules and the heatsinks are then assembled with a lamp case. Because the quantities of the LED modules, heatsinks and power supplies can be increased or reduced to adjust the brightness of the illumination, the flexibility and economy for assembling the LED lighting device can be enhanced. When some of the LED chips or part of the other electronic components is in failure and needs replacement, it only needs to have the failure parts replaced instead of having to replace all of the LED modules or all of the electronic components.

The technical means of the present invention is to provide a light case, a plurality of heatsinks, a plurality of LED modules and a plurality of power supplies. Each of the heatsinks is disposed with one of the LED modules and one of the power supplies correspondingly to form one LED light unit. The LED light units are assembled on the light case to form a LED lighting device. Each of the power supplies is connected to a power source to provide electricity for each of the LED light units. When one of the LED light units is in failure, it only needs to replace the failure LED light unit.

BRIEF DESCRIPTION OF THE DRAWINGS

The present invention will be apparent to those skilled in the art by reading the following detailed description of a preferred embodiment thereof, with reference to the attached drawings, in which.

DETAILED DESCRIPTION OF THE PREFERRED EMBODIMENT

Figure 1:
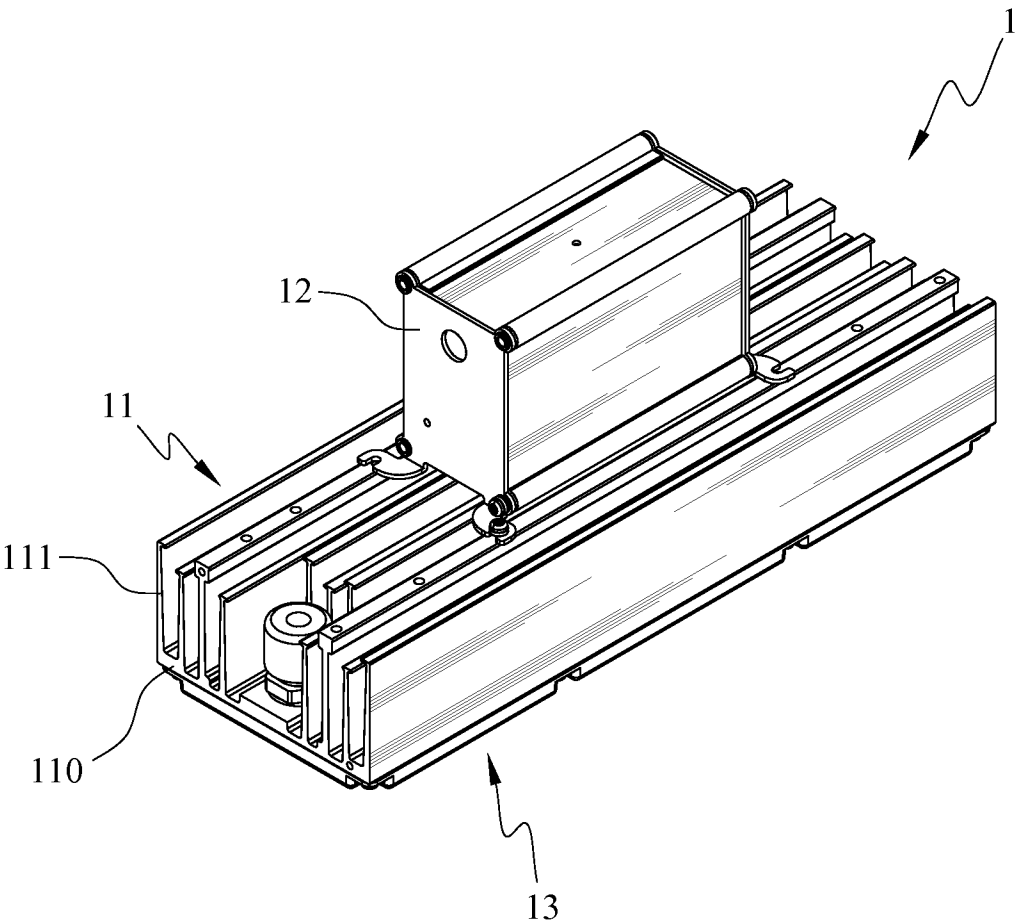
FIG. 1 is a perspective view showing a LED light unit according to the present invention.
Figure 2:
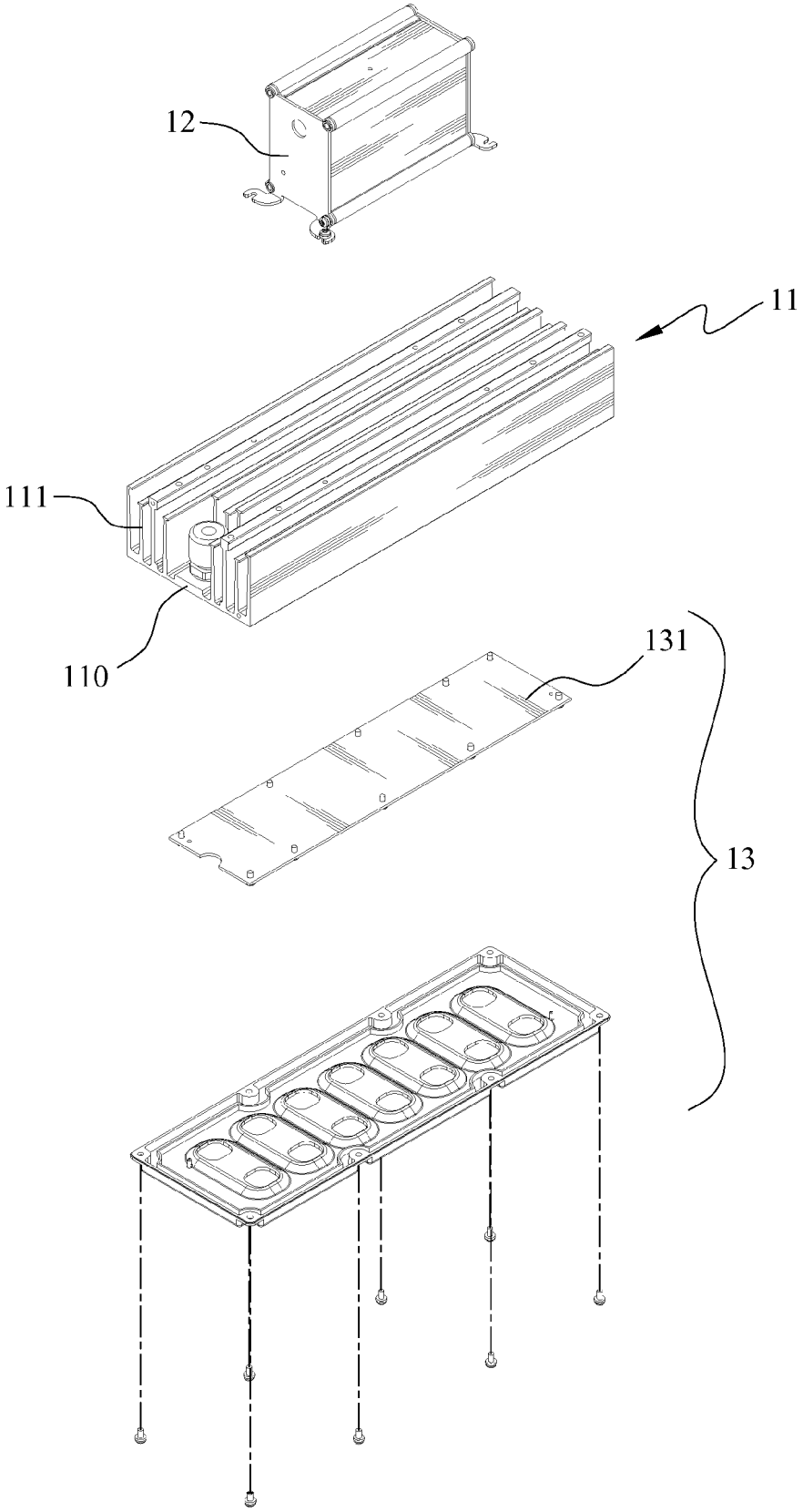
FIG. 2 is an exploded view showing the LED light unit according to the present invention.
Figure 3:
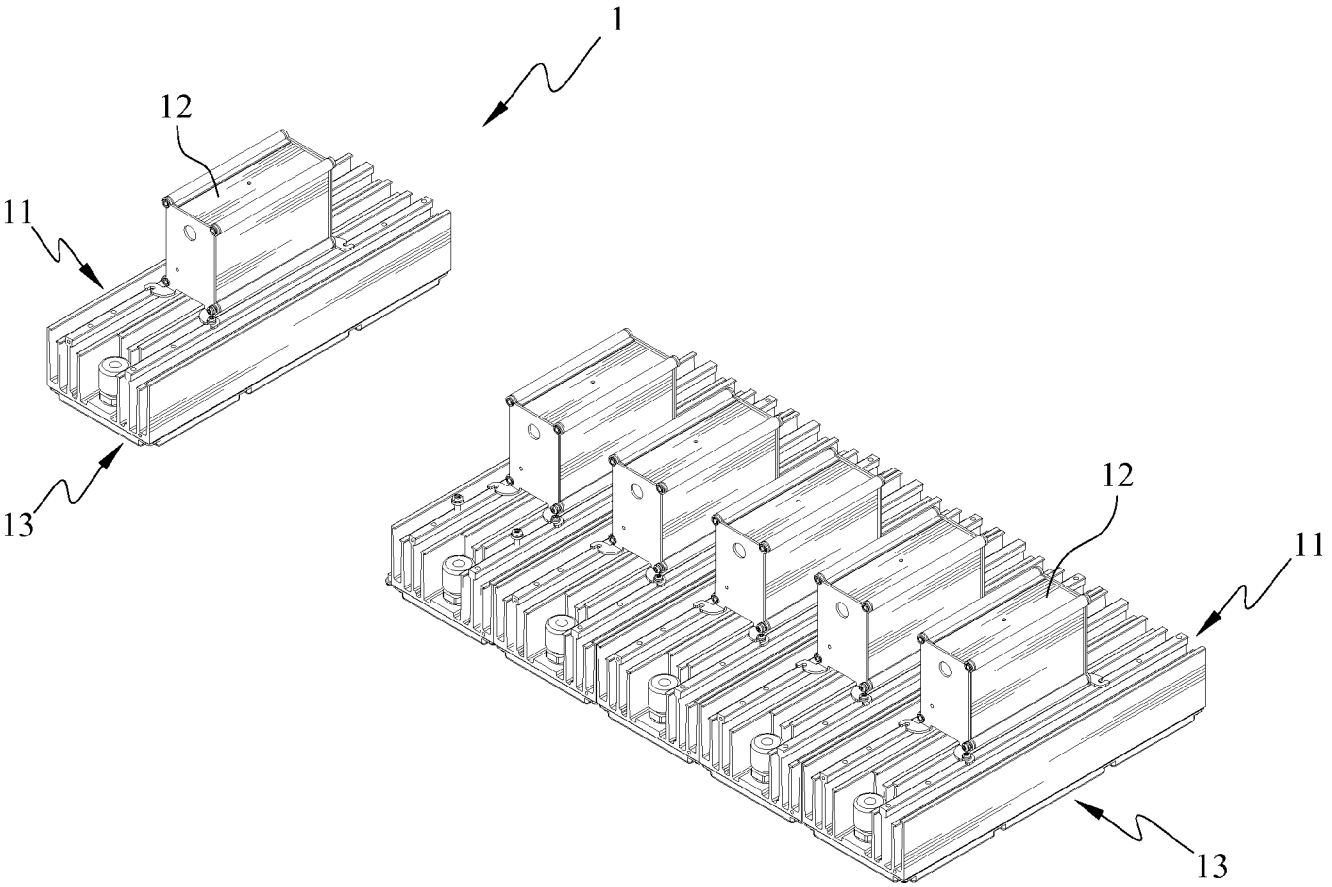
FIG. 3 is a perspective view showing the LED light units according to an embodiment of the present invention being assembled side by side together.
Figure 4:
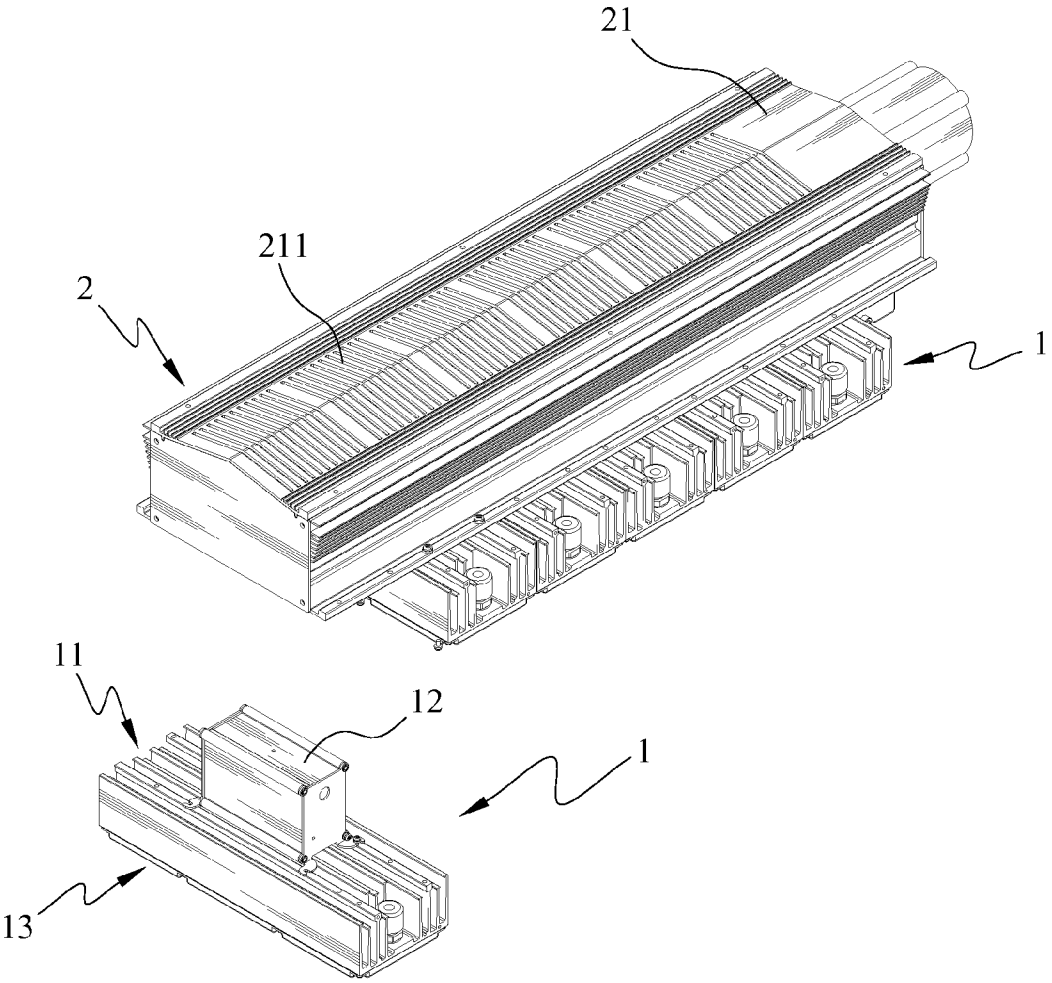
FIG. 4 is a perspective view showing the LED light units according to the embodiment of the present invention being assembled side by side together on a light case to form a LED lighting device.
Figure 5:
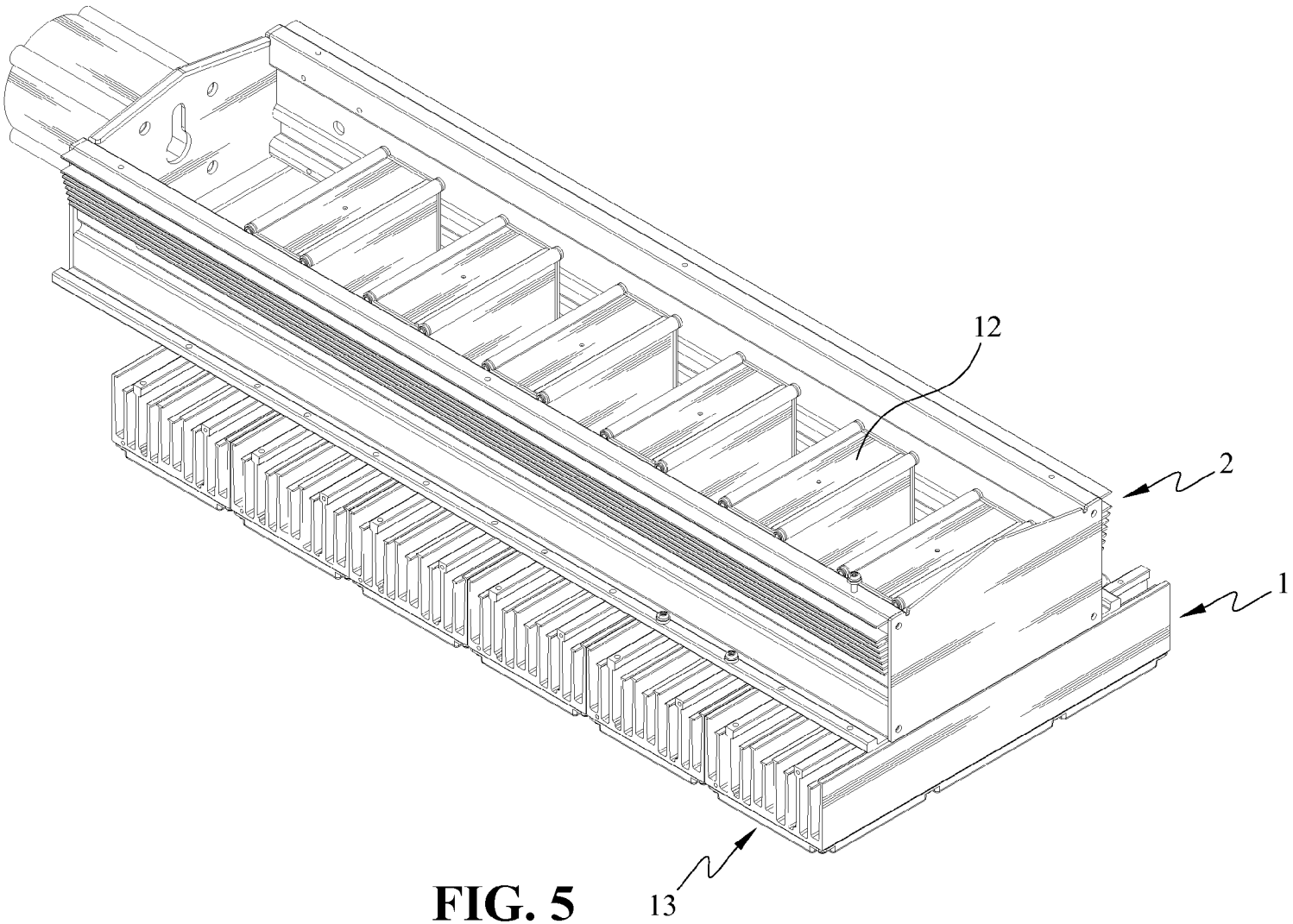
FIG. 5 is a perspective view showing the LED light units according to the embodiment of the present invention being assembled side by side together on the light case and a top cover of the light case being removed to show the internal structure.
Figure 6:
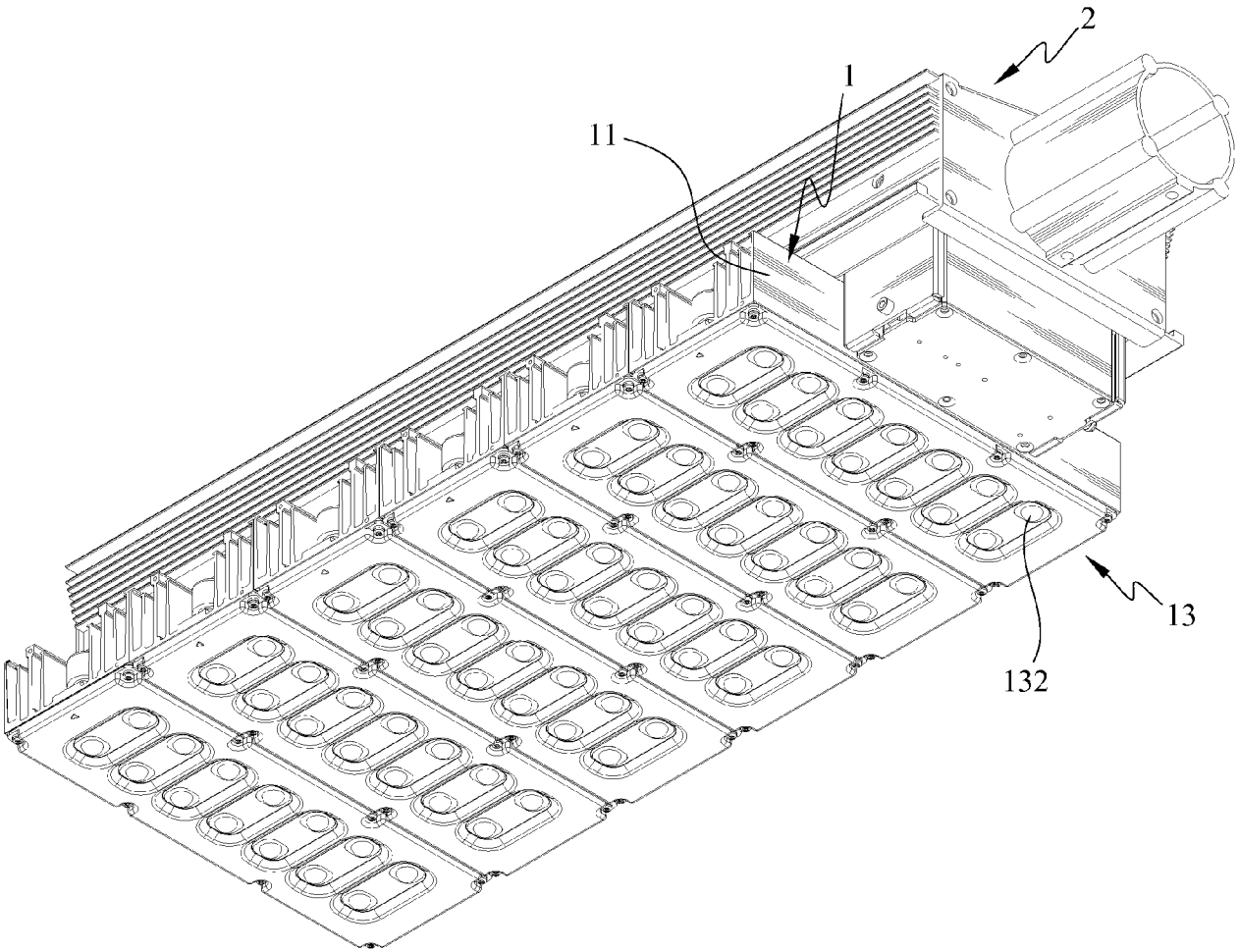
FIG. 6 is a perspective view showing the LED lighting device units according to the embodiment of the present invention.

FIG. 1 is a perspective view showing a LED light unit 1 according to the present invention and FIG. 2 is an exploded view showing the LED light unit 1 according to the present invention. As shown in FIGS. 1 and 2, the LED light unit 1 comprises a heatsink 11, a power supply 12 and a LED module 13. The heatsink 11 includes a base 110 and a plurality of fins 111 connected with the base 110. The base 110 and the fins 111 of the heatsink 11 may be integrally formed in one piece by extrusion. The LED module 13 comprises a circuit board 131 and a plurality of LEDs 132 mounted on the circuit board 131. The quantity of the LEDs 132 is determined by the brightness of illumination of unit area. The circuit board 131 is mounted onto the base 110 of the heatsink 11. Thereby, the heat produced by the illuminating LEDs 132 is conducted to the fins 111 through the base 110. The heat is then carried away by air flow to the exterior environment. Otherwise, a fan (not shown in drawings) may be provided to generate air flow and dissipate the heat energy.

Each of the heatsink 11 has one of the power supplies 12 installed thereon. Preferably, the power supply 12 is disposed on tops of the fins 111 of the heatsink 11. The power supply 12 can be installed by penetrating screws through holes of the power supply 12 and then locking the screws into screw holes of the heatsink 11. The power supply 12 connects with an alternating current power source and converts an alternating current into a direct current to provide power for the LED module 13.

Each heatsink 11 has one power supply 12 installed thereon. Preferably, the power supply 12 is disposed on tops of the fins 111 of the heatsink 11. The power supply 12 can be installed by penetrating screws through holes of the power supply 12 and then locking the screws into screw holes of the heatsink 11. The power supply 12 connects with an alternating current power source and converts an alternating current into a direct current to provide power for the LED module 13.

The finished product of the conventional LED lighting device does not allow the quantity of the LED module, the heatsink and the power supply to be expanded or contracted. Thus, it is inflexible for the conventional LED lighting device to increase or reduce the brightness of the illumination. The LED module, the heatsink and the power supply have to be replaced all together and matched again correspondingly if any component is in failure. Thus, it is uneconomical to replace the entire LED module or the other electronic components when they are failed. The LED lighting device according to the present invention overcomes the disadvantages of the conventional LED lighting device. The LED lighting device according to the present invention can individually increase or reduce the quantity of the LED light units, and can replace the failed component only. Thus, it enhances the flexibility of assembling and is economical to use.

Although the present invention has been described with reference to the preferred embodiment thereof, it is apparent to those skilled in the art that a variety of modifications and changes may be made without departing from the scope of the present invention which is intended to be defined by the appended claims.

What is claimed is:

1. A LED lighting device, comprising:

a plurality of LED light units, each of the LED light units including a heatsink, a LED module and a power supply, the LED module and the power supply being respectively connected with the heatsink; and a light case, the LED light units being directly assembled to the light case with the plurality of power supplies accommodated inside the light case;

wherein each of the LED light units has its own respective heatsink, LED module and power supply, and can be individually replaced.

2. The device as claimed in claim 1, wherein the heatsink comprises a base and a plurality of fins disposed on a side of the base, the power supply is disposed on the fins and the LED module is disposed on another side of the base opposite to the side where the fins are disposed.

3. The device as claimed in claim 2, wherein the power supply is disposed inside the light case, the heatsink and the LED module are disposed below the light case.

4. The device as claimed in claim 1, wherein the power supply is disposed inside the light case, the heatsink and the LED module are disposed below the light case.

* * * * *